US012601506B2

(12) United States Patent
Bernauer et al.

(10) Patent No.: US 12,601,506 B2
(45) Date of Patent: Apr. 14, 2026

(54) DOOR AND DOMESTIC COOKING DEVICE

(71) Applicant: BSH Hausgeräte GmbH, Munich (DE)

(72) Inventors: Maximilian Bernauer, Kienberg (DE); Frederic Dubois, Trostberg (DE); Maximilian Huber, Dorfen (DE); David Marechal, Grabenstätt (DE); Christine Thaller, Waging (DE)

(73) Assignee: BSH Hausgeräte GmbH, Munich (DE)

( * ) Notice: Subject to any disclaimer, the term of this patent is extended or adjusted under 35 U.S.C. 154(b) by 507 days.

(21) Appl. No.: 18/008,686

(22) PCT Filed: Jul. 7, 2021

(86) PCT No.: PCT/EP2021/068831

§ 371 (c)(1),
(2) Date: Dec. 7, 2022

(87) PCT Pub. No.: WO2022/017793

PCT Pub. Date: Jan. 27, 2022

(65) Prior Publication Data

US 2023/0221008 A1 Jul. 13, 2023

(30) Foreign Application Priority Data

Jul. 22, 2020 (DE) ..... 102020209243.5

(51) Int. Cl.
*F24C 15/34* (2006.01)
*F24C 15/00* (2006.01)
*F24C 15/02* (2006.01)

(52) U.S. Cl.
CPC ..... *F24C 15/34* (2013.01); *F24C 15/006* (2013.01); *F24C 15/024* (2013.01)

(58) Field of Classification Search
CPC .... F24C 15/028; F24C 15/023; F24C 15/045; F24C 15/02
(Continued)

(56) References Cited

U.S. PATENT DOCUMENTS 5,819,722 A * 10/1998 Katz ..... F24C 15/006 126/200
9,958,166 B2 * 5/2018 Braden ..... F24C 15/04
(Continued)

FOREIGN PATENT DOCUMENTS

DE 102011088073 A1 6/2013
DE 102017220214 A1 5/2019
(Continued)

OTHER PUBLICATIONS

National Search Report DE102020209243.5 dated Feb. 24, 2021.
(Continued)

*Primary Examiner* — Allen R. B. Schult
*Assistant Examiner* — Amy E Carter
(74) *Attorney, Agent, or Firm* — Michael E. Tschpp; Andre Pallapies; Brandon G. Braun

(57) ABSTRACT

A door for a household cooking appliance includes an outer pane, a first door support connected to the outer pane, a second door support connected to the outer pane, and a shielding facility having at least one portion configured to shield the outer pane and at least one of the first and second door supports from thermal radiation. The shielding facility is arranged between the first door support and the second door support. At least one of the first and second door supports has at least one portion arranged between the outer pane and the shielding facility.

19 Claims, 17 Drawing Sheets

(58) Field of Classification Search
USPC ..... 126/190, 198, 194
See application file for complete search history.

(56) References Cited

U.S. PATENT DOCUMENTS

| | | | | |
|---|---|---|---|---|
| 2004/0159317 | A1* | 8/2004 | Walther | F24C 15/006 126/193 |
| 2005/0028805 | A1 | 2/2005 | Bronstering | |
| 2012/0216789 | A1* | 8/2012 | Vazquez Garcia | F24C 15/04 126/200 |

FOREIGN PATENT DOCUMENTS

| | | | |
|---|---|---|---|
| EP | 2592354 | A1 | 5/2013 |
| KR | 20090064613 | A | 6/2009 |

OTHER PUBLICATIONS

International Search Report PCT/EP2021/068831 dated Sep. 21, 2021.
National Search Report EP 21 740 497.9 dated Dec. 20, 2024.

* cited by examiner

DOOR AND DOMESTIC COOKING DEVICE

CROSS-REFERENCES TO RELATED APPLICATIONS

This application is the U.S. National Stage of International Application No. PCT/EP2021/068831, filed Jul. 7, 2021, which designated the United States and has been published as International Publication No. WO 2022/017793 A1 and which claims the priority of German Patent Application, Serial No. 10 2020 209 243.5, filed Jul. 22, 2020, pursuant to 35 U.S.C. 119 (a)-(d).

The contents of International Application No. PCT/EP2021/068831 and German Patent Application, Serial No. 10 2020 209 243.5 are incorporated herein by reference in their entireties as if fully set forth herein.

BACKGROUND OF THE INVENTION

The present invention relates to a door for a household cooking appliance and a household cooking appliance having such a door.

A household cooking appliance can have a cooking chamber comprising a door which is pivotably attached to the cooking chamber. The door can have an inner pane facing the cooking chamber, an outer pane facing away from the cooking chamber and an intermediate pane arranged between the inner pane and the outer pane. During the operation of the household cooking appliance, in particular in pyrolysis mode, it is imperative that the outer pane and a handle attached to the outer pane do not exceed a permitted maximum temperature.

BRIEF SUMMARY OF THE INVENTION

Against this background, it is an object of the present invention to provide an improved door for a household cooking appliance.

Accordingly, a door for a household cooking appliance is proposed. The door comprises an outer pane, a first door support which is connected to the outer pane, a second door support which is connected to the outer pane, and a shielding facility for shielding the outer pane, the first door support and/or the second door support in some portions from thermal radiation, wherein the shielding facility is arranged between the first door support and the second door support, and wherein at least one of the door supports is arranged at least in some portions between the outer pane and the shielding facility.

Since the shielding facility is provided, it is possible to prevent an undesired heating of the outer pane and the door supports in a reliable manner. On the one hand, this prevents possible damage to the door supports, which are preferably produced from plastics material, and reduces the risk of injury to a user when touching the door.

The household cooking appliance can be a stove, an oven, a microwave combination oven, a double oven, or the like Preferably, the household cooking appliance comprises a cooking chamber to which the door, for example, is pivotably attached. Hinges can be provided therefor. The hinges can be coupled in each case to one of the door supports. However, this is not absolutely necessary. Alternatively, the door can also be arranged on an oven carriage or the like, which can be pulled out of the cooking chamber. In this case, the door is not pivotably attached to the cooking chamber but is displaceable relative thereto in a linear manner.

Preferably, in addition to the outer pane, the door comprises an inner pane facing the cooking chamber as well as a plurality of intermediate panes which are arranged between the outer pane and the inner pane. Preferably, the door supports are fixedly connected to the outer pane. For example, the door supports are adhesively bonded to the outer pane. Alternatively, the door supports can also be releasably connected to the outer pane. The door supports are attached to the outer pane at the side and when the door is closed the door supports run in a y-direction or vertical direction of the household cooking appliance or the door. The door supports are attached to the outer pane on the rear face, for example adhesively bonded thereto.

The door is able to be dismounted from the cooking chamber so that the door can be dismantled and reassembled in its state dismounted from the cooking chamber. Moreover, the door can also be dismantled and reassembled in a state mounted on the cooking chamber. The outer pane, the inner pane and the intermediate panes are preferably transparent at least in some portions. In principle, there can be any number of intermediate panes. For example, one intermediate pane can be provided. However, two intermediate panes or three intermediate panes can also be provided. The intermediate pane or the intermediate panes can be produced from glass, a sol-gel, a polycarbonate, or the like. Alternatively, the intermediate pane or the intermediate panes can be configured as a screen made of metal, non-ferrous metal or plastic.

Preferably, when viewed in the direction from the cooking chamber to the outer pane, the shielding facility covers or conceals at least one of the door supports at least in some portions. In particular, the shielding facility and the door supports can be positively engaged, preferably when a connection between one of the door supports and the outer pane becomes loose. As a result, the door supports or one of the door supports are prevented, or is prevented, from falling off the door when the connection fails. A positive connection is established by the engagement of a plurality of connection partners, in the present case the shielding facility and the door supports, in one another or behind one another. During the operation of the household cooking appliance, thermal radiation is introduced into the door, in particular from the cooking chamber. The shielding facility ensures that the thermal radiation is reflected back into the cooking chamber at least in the region of the shielding facility.

According to one embodiment, the shielding facility comprises a first tab which is in engagement with the first door support and a second tab which is in engagement with the second door support.

The engagement can be positive, in particular the first tab and the second tab are latched or snapped into the respective door support. The positive connection between the tabs and the door supports can be released again, for example by a resilient deformation of the tabs, so that the shielding facility can be detached from the door supports.

According to a further embodiment, a gap is provided between the shielding facility and the outer pane.

Preferably, the gap receives a stationary air cushion. The stationary air cushion has, in particular, an insulating action or isolating action and thereby prevents the outer pane from heating up in the region of the shielding facility. Alternatively, air can also flow through the gap. In this case, a stationary air cushion is not provided in the gap.

According to a further embodiment, the shielding facility is supported on the outer pane.

In other words, the shielding facility is in contact with the outer pane, in particular an inner face of the outer pane facing the cooking chamber.

According to a further embodiment, the shielding facility comprises a first support portion which is supported on the outer pane and a second support portion which is also supported on the outer pane.

The first support portion and the second support portion are positioned spaced apart from one another, when viewed in the vertical direction. Preferably, the shielding facility bears against the outer pane with a spring pretensioning. As a result, a visible gap is prevented between the inner face of the outer pane and the support portions of the shielding facility.

According to a further embodiment, the first support portion has a cut-out, air flowing through said cut-out between the shielding facility and the outer pane.

In this case, a stationary air cushion is not provided between the shielding facility and the outer pane, but the air flows through the gap. As a result, an additional cooling of the shielding facility can be achieved.

According to a further embodiment, the shielding facility comprises ventilation slots or a cut-out provided on the second support portion.

The air flowing into the gap can be discharged again through the ventilation slots or through the cut-out. When viewed in the vertical direction, the ventilation slots are arranged, or the cut-out provided on the second support portion is arranged, above the cut-out provided on the first support portion.

According to a further embodiment, the shielding facility has properties which reflect thermal radiation, at least facing away from the outer pane.

In other words, the shielding facility is suitable for reflecting back into the cooking chamber the thermal radiation which falls from the cooking chamber onto the door. For example, the shielding facility can be produced from a stainless steel sheet. A brushed surface of the shielding facility facing the cooking chamber serves for reflecting the thermal radiation.

According to a further embodiment, the shielding facility is a bent sheet metal component.

As a result, the shielding facility can be manufactured cost-effectively. Alternatively, the shielding facility can also be a plastic component. In this case, the shielding facility can be provided, for example, with a reflective coating for reflecting the thermal radiation.

According to a further embodiment, the first door support and the second door support are arranged spaced apart from one another, when viewed in a width direction of the door, wherein the shielding facility runs between the first door support and the second door support, when viewed in the width direction.

The width direction is an x-direction of the door. The width direction or x-direction, the vertical direction or y-direction and a depth direction or z-direction form a coordinate system of the door. In this case, the directions are oriented perpendicular to one another.

According to a further embodiment, the door comprises a handle which is provided on the door and at least one fastening element for fastening the handle to the door, wherein the at least one fastening element is guided through a through-hole which is provided on the shielding facility.

The handle is optional. The door can also be without a handle. Two fastening elements, which are arranged on the door at the side, are preferably provided. The fastening elements are, for example, screws which are guided through the through-holes provided in the shielding facility. The screws are screwed to the handle.

According to a further embodiment, the at least one fastening element positively engages behind the shielding facility.

In other words, in addition to the positive connection to the door supports, the shielding facility is also positively connected to the door by means of the fastening elements.

According to a further embodiment, the shielding facility shields the handle from thermal radiation.

The handle is located behind the shielding facility, when viewed in the depth direction. Since the shielding facility shields the handle from thermal radiation, the handle is reliably prevented from heating up beyond a permitted level.

According to a further embodiment, the first door support and the second door support are coupled to the outer pane by means of the shielding facility and the at least one fastening element.

In other words, even if a connection between the door supports and the outer pane fails, the door supports are held on the outer pane by means of the shielding facility and the fastening elements. Individual components are thus reliably prevented from falling down, even in the case of damage to the connection between the door supports and the outer pane.

A household cooking appliance, comprising a cooking chamber and such a door which is attached to the cooking chamber, is also proposed.

The household cooking appliance, as mentioned above, can be a stove, an oven, a microwave combination oven, a double oven, or the like. "Attached" in the present case means that the door is connected to the cooking chamber, for example, so as to be vertically or horizontally pivotable. Alternatively, the door can also be arranged on an oven carriage which can be extended out of the cooking chamber. In this case, the door is not pivotably mounted on the cooking chamber but is displaceable or movable relative thereto in a linear manner. However, the door can perform any movement when opened.

Further possible implementations of the door and/or the household cooking appliance also comprise not explicitly mentioned combinations of features or embodiments described above or below relative to the exemplary embodiments. In this case, the person skilled in the art will also add individual aspects as improvements or additions to the respective basic form of the door and/or the household cooking appliance.

BRIEF DESCRIPTION OF THE DRAWINGS

Further advantageous embodiments and aspects of the door and/or the household cooking appliance form the subject matter of the subclaims and the exemplary embodiments of the door and/or the household cooking appliance described below. The door and/or the household cooking appliance are explained in more detail hereinafter by way of preferred embodiments with reference to the accompanying figures.

DETAILED DESCRIPTION OF EXEMPLARY EMBODIMENTS OF THE PRESENT INVENTION

Elements which are the same or functionally the same have been provided with the same reference signs in the figures, unless specified otherwise.

Figure 1:
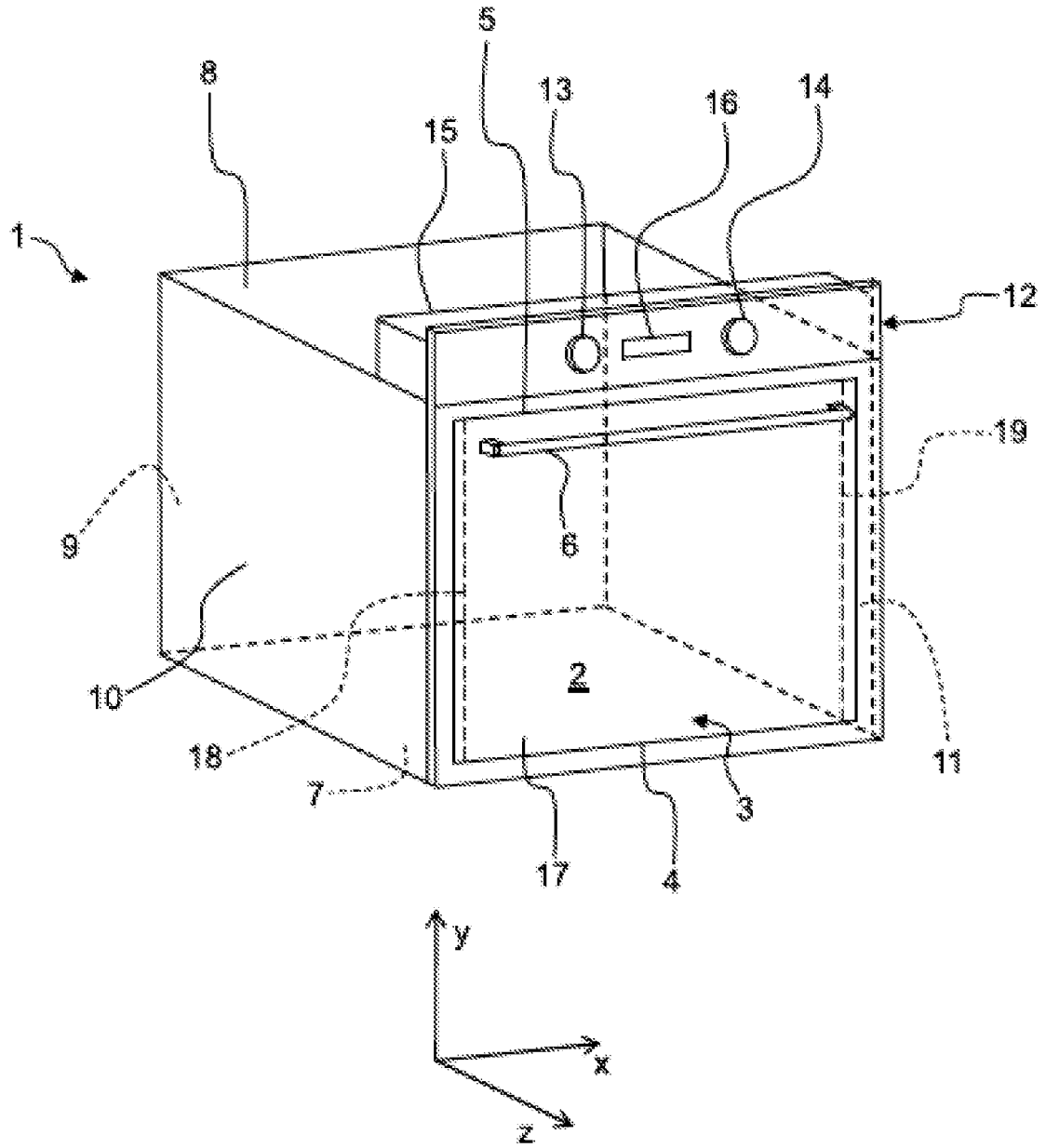
FIG. 1 shows a schematic perspective view of an embodiment of a household cooking appliance.

FIG. 1 shows a schematic perspective view of an embodiment of a household cooking appliance 1. The household cooking appliance 1 can be a stove, an oven, a microwave combination oven, a double oven or the like. The household cooking appliance 1 has a cooking chamber 2 which can be closed by means of a door 3. The cooking chamber 2 can also be denoted as a muffle or oven muffle. The cooking chamber 2 can be arranged in the interior of a housing of the household cooking appliance 1. The door 3 is shown in FIG. 1 in a closed position. The door 3 can be closed or opened by pivoting about a pivot axis provided at a lower end of the door 3 or a lower edge 4 of the door 3. Alternatively, the door 3 can be attached to the cooking chamber 2 at the side. Moreover, the door 3 can be arranged on an oven carriage which can be pulled out of the cooking chamber 2. However, it is possible to select any type of movement of the door 3 when the door 3 is opened. In other words, in principle the door 3 can perform any movement when opened.

A handle 6 can be provided on an upper portion or on an upper edge 5 of the door 3. However, the door 3 can also be without a handle. The cooking chamber 2 has a bottom 7, a ceiling 8 arranged opposite the bottom 7, a rear wall 9 arranged opposite the closed door 3 and two side walls 10, 11 arranged opposite one another. The cooking chamber 2 is preferably cuboidal or cube-shaped. The cooking chamber 2 can be produced from a metal material, in particular from sheet steel.

The household cooking appliance 1 also comprises control knobs 13, 14 provided on a switch panel or control panel 12. The control knobs 13, 14 can be rotatable, for example. A control facility 15, only shown schematically, can be provided on the rear face on the control panel 12 for controlling the household cooking appliance 1. The control facility 15 can be a regulating facility and/or control facility. A display 16 can also be provided on the control panel 12. An operating state of the household cooking appliance 1 can be displayed by means of the display 16. For example, a temperature set by means of the control knobs 13, 14 can be displayed by means of the display 16.

The household cooking appliance 1 can be capable of pyrolysis. In other words, the cooking chamber 2 can be burnt out by means of a correspondingly high temperature. Dirt adhering to the cooking chamber 2 and to the door 3 on the inner face is carbonized thereby, so that this dirt either drops off automatically or can be easily removed. However, this pyrolysis function is not absolutely necessary. The door 3 is a ventilated door. In other words, an air flow is conducted through the door 3.

A coordinate system having a width direction or x-direction x, a vertical direction or y-direction y, and a depth direction or z-direction z is assigned to the household cooking appliance 1 or the door 3. The directions x, y, z are oriented perpendicular to one another. The door 3 comprises an outer pane 17 which is located in a plane spanned by the x-direction x and the y-direction y. On the rear face, i.e. facing the cooking chamber 2, a first door support 18 and a second door support 19 are attached to the outer pane 17. When the door 3 is closed, the door supports 18, 19 run in the y-direction y. The door supports 18, 19 are preferably adhesively bonded to the outer pane 17 on the rear face. However, the door supports 18, 19 can be connected in any other manner to the outer pane 17. For example, the door supports 18, 19 are mounted in the outer pane 17. The door supports 18, 19 are produced from a plastics material. Hinges, not shown, can be attached to the door supports 18, 19 so that the door 3 can be pivotably attached to the cooking chamber 2.

Figure 2:
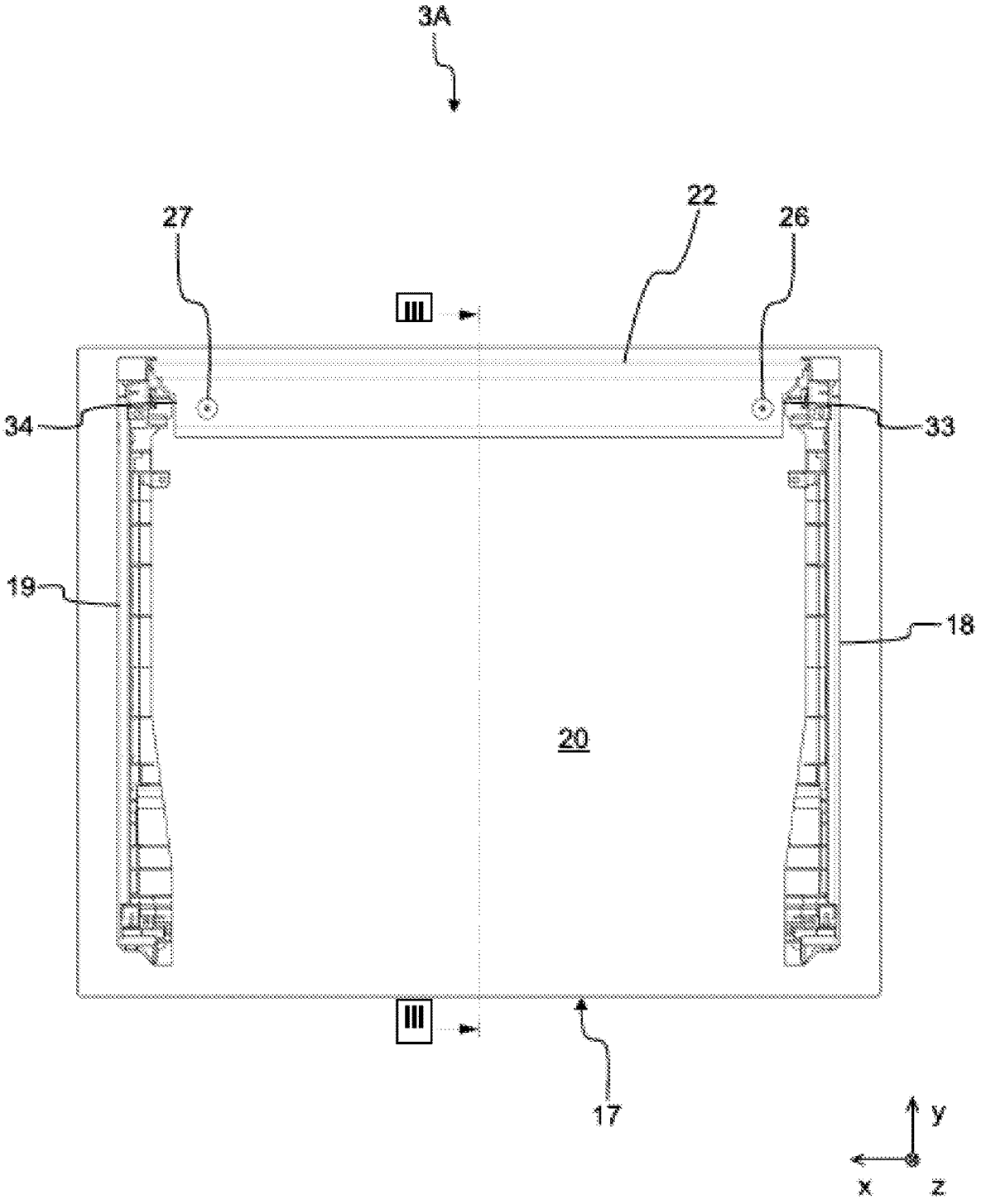
FIG. 2 shows a schematic plan view of an embodiment of a door for the household cooking appliance according to FIG. 1.
Figure 3:
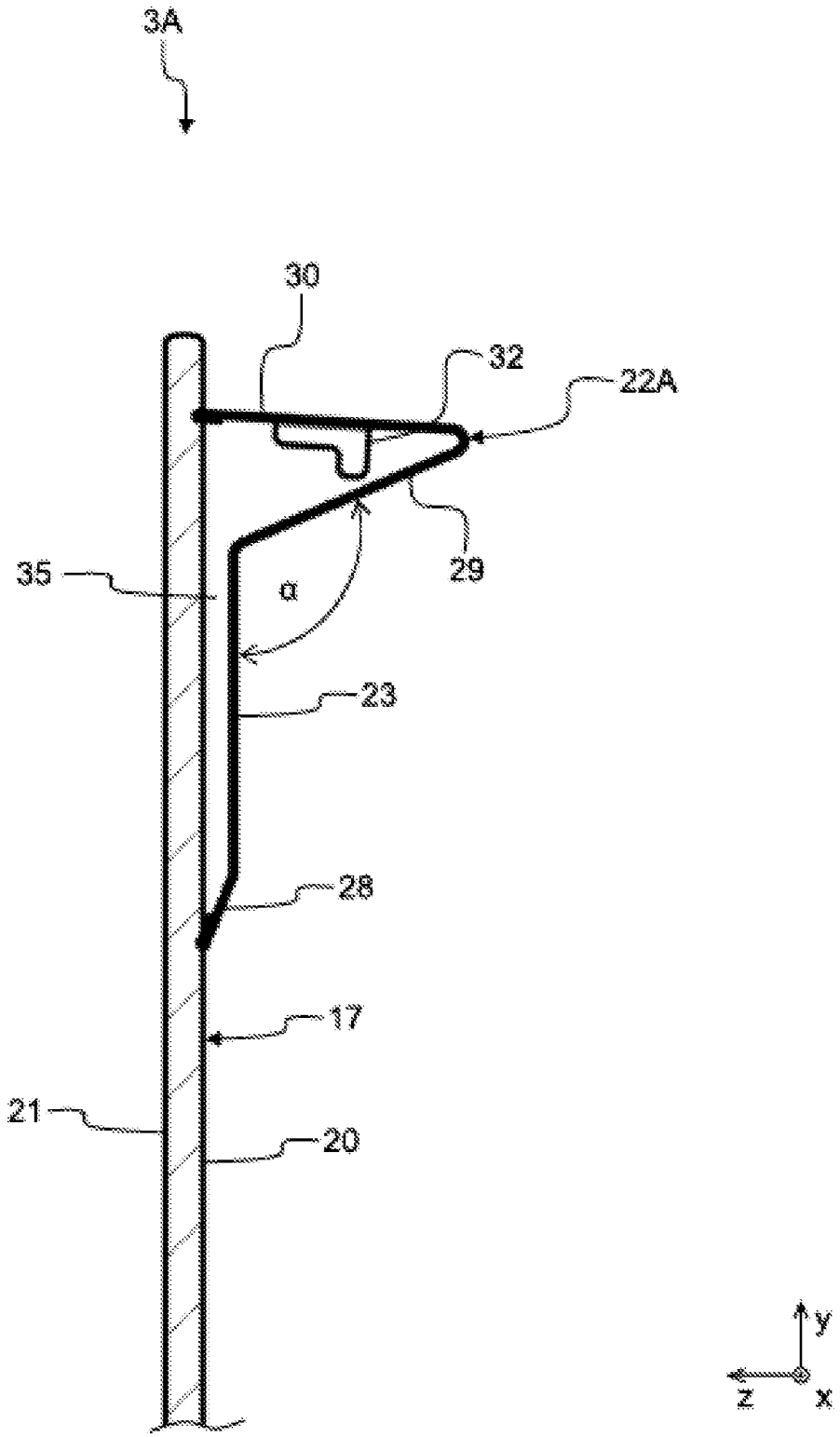
FIG. 3 shows a schematic sectional view of the door along the cutting line III-III of FIG. 2.

FIG. 2 shows a schematic plan view of an embodiment of a door 3A for the household cooking appliance 1, when viewed in the direction from the cooking chamber 2 to the door 3A on the rear face. FIG. 3 shows a sectional view of the door 3A along the cutting line III-III of FIG. 2. Reference is made to FIGS. 2 and 3 hereinafter at the same time.

As mentioned above, the door 3A comprises the outer pane 17, the door supports 18, 19 being adhesively bonded thereto on the rear face. However, the door supports 18, 19 can also be connected in any other manner to the outer pane 17. In addition to the outer pane 17, the door 3A comprises an inner pane (not shown) facing the cooking chamber 2. A first intermediate pane and a second intermediate pane (not shown) can be provided between the outer pane 17 and the inner pane. In principle, there can be any number of intermediate panes. The first intermediate pane is arranged closer to the outer pane 17 than the second intermediate pane. Accordingly, the second intermediate pane is arranged closer to the inner pane than the first intermediate pane.

During the operation of the household cooking appliance 1, in particular in pyrolysis mode, air circulates between the outer pane 17 and the first intermediate pane and between the first intermediate pane and the second intermediate pane. A stationary air cushion is provided between the second intermediate pane and the inner pane. This serves for thermal insulation. However, this stationary air cushion is not absolutely necessary. Dirt can be deposited on the intermediate panes, the inner pane and/or on the outer pane 17. Thus a user can remove the inner pane and the intermediate panes from the door 3A for cleaning.

The door supports 18, 19 run in the y-direction y and are positioned spaced apart from one another, when viewed in the x-direction x. The outer pane 17 comprises an inner face 20 which faces the cooking chamber 2 as well as an outer face 21 which faces away from the cooking chamber 2. The door supports 18, 19 are provided on the inner face 20. The door 3A further comprises a shielding facility 22A which is provided on the inner face 20. The shielding facility 22A runs between the first door support 18 and the second door support 19, when viewed in the x-direction x. In other words, the shielding facility 22A runs in the x-direction x.

The first door support 18 and the second door support 19 are covered or concealed at least in some portions by the shielding facility 22A, when viewed in the direction from the cooking chamber 2 to the outer pane 17. In particular, the door supports 18, 19 are arranged, or at least one of the door supports 18, 19 is arranged, at least in some portions between the outer pane 17 and the shielding facility 22A. Thus the door supports 18, 19 are held on the door 3A even if the connection of the door supports 18, 19 or one of the door supports 18, 19 to the door 3A fails.

The shielding facility 22A is suitable for shielding the outer pane 17, the door supports 18, 19 and/or the handle 6 at least in some portions from thermal radiation which falls from the cooking chamber 2 onto the door 3A. In this case, the shielding facility 22A can be positively connected to the first door support 18 and the second door support 19. However, this is not absolutely necessary. A positive connection is established by at least two connection partners, in the present case the shielding facility 22A and the door supports 18, 19, engaging in one another or behind one another. A positive connection is able to be released again without destroying the connection partners.

Figure 4:
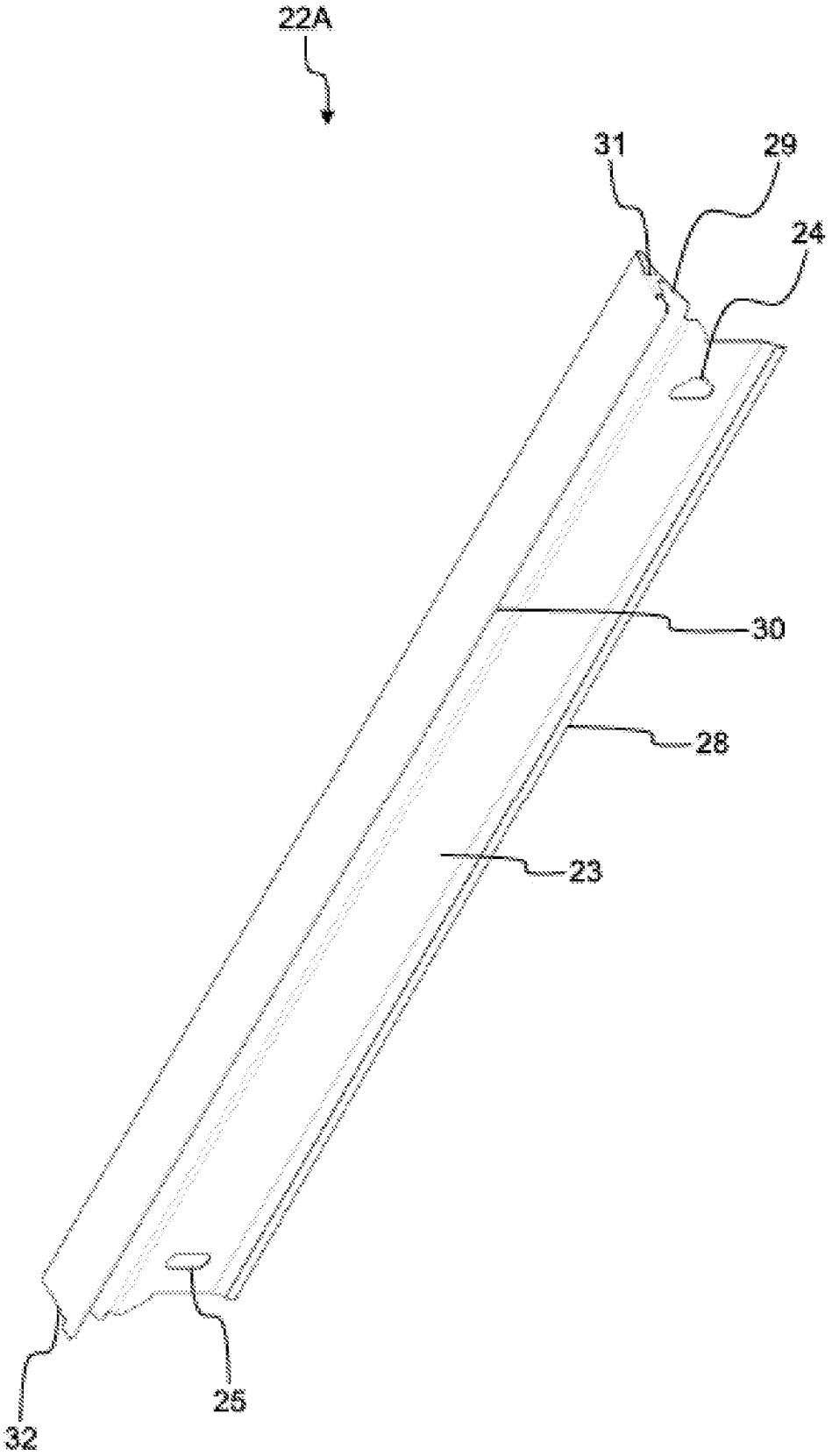
FIG. 4 shows a schematic perspective view of an embodiment of a shielding facility for the door according to FIG. 2.
Figure 5:
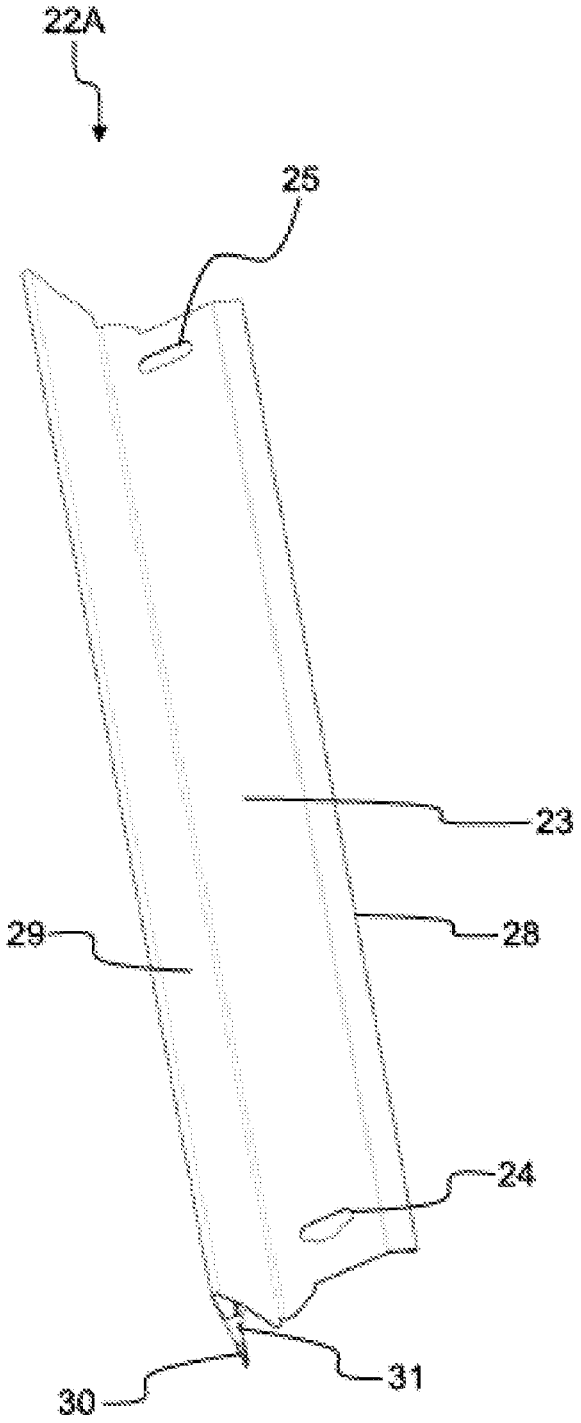
FIG. 5 shows a further schematic perspective view of the shielding facility according to FIG. 4.

FIG. 4 shows a schematic perspective view of the shielding facility 22A. FIG. 5 shows a further schematic perspective view of the shielding facility 22A. Reference is made to FIGS. 4 and 5 hereinafter at the same time.

The shielding facility 22A is a bent sheet metal component. As a result, the shielding facility can be manufactured cost-effectively. However, the shielding facility 22A can also be a plastic component. The shielding facility 22A has properties which reflect thermal radiation, at least facing away from the outer pane 17. For example, the shielding facility 22A can have a reflective surface. In particular, the shielding facility 22A can have a brushed surface. The shielding facility 22A can be a stainless steel sheet. The shielding facility 22A also covers the handle 6, when viewed from the cooking chamber 2. Thus the shielding facility 22A shields the handle 6 from thermal radiation.

The shielding facility 22A comprises a plate-shaped base portion 23 which runs parallel to the inner face 20 of the outer pane 17 and is arranged spaced apart therefrom. The base portion 23 comprises a first through-hole 24 and a second through-hole 25. In this case, the through-holes 24, 25 are arranged spaced apart from one another, when viewed in the x-direction x. The through-holes 24, 25 can be configured as slots. Fastening elements 26, 27 (FIG. 2), in particular screws, can be guided through the through-holes 24, 25. The handle 6 can be connected to the door 3A by means of the fastening elements 26, 27. However, the door 3A can also be without a handle.

The fastening elements 26, 27 are guided through the through-holes 24, 25 of the base portion 23, wherein the fastening elements 26, 27 positively engage behind the shielding facility 22A. As a result, in addition to the connection to the door supports 18, 19, the shielding facility 22A is fixedly connected to the door 3A. As the shielding facility 22A in turn is positively connected to the door supports 18, 19, the first door support 18 and the second door support 19 are coupled to the outer pane 17 by means of the shielding facility 22A and the fastening elements 26, 27. In other words, even if the adhesively bonded connection fails between the door supports 18, 19 and the inner pane 17, the door supports 18, 19 remain on the door 3A and cannot be released therefrom.

The shielding facility 22A comprises a first support portion 28 which is supported on the inner face 20 of the outer pane 17. A portion 29 of the shielding facility 22A protruding in the direction of the cooking chamber 2 and facing away from the first support portion 28 adjoins the base portion 23. A second support portion 30 extending in the direction of the inner face 20 of the outer pane 17 adjoins the portion 29. The second support portion 30 also bears against the inner face 20 of the outer pane 17. A first tab 31 which can be positively engaged with the first door support 18 is provided on the second support portion 30. The shielding facility 22A also comprises a second tab 32 which can be positively engaged with the second door support 19. The tabs 31, 32 are resiliently deformable so that they can be latched into the door supports 18, 19.

As FIG. 3 shows, the base portion 23 and the portion 29 are inclined relative to one another at an angle of inclination a. The angle of inclination a is preferably more than 90°. As FIG. 2 further shows, on either side the shielding facility 22A has cut-outs 33, 34 in which the door supports 18, 19 are located. A gap 35 is provided between the shielding facility 22A and the outer pane 17. The gap 35 preferably comprises a stationary air cushion which serves for the thermal insulation. However, air can also flow through the gap 35.

The region of the door 3A in which the handle 6 is arranged is subject to strict requirements relative to maximum permitted temperatures, in particular during pyrolysis mode. Additionally, a shielding and insulation is advantageous for energy consumption requirements. These requirements can be achieved by means of the shielding facility 22A. If the door supports 18, 19 are adhesively bonded to the outer pane 17, components are prevented from falling off the door 3A, even in the case of a failure of the adhesive bond between the door supports 18, 19 and the outer pane 17, by the shielding facility 22A being positively connected to the door supports 18, 19 and the shielding facility 22A in turn being connected by means of the fastening elements 26, 27 to the outer pane 17. Additionally, the shielding facility 22A ensures that no dirt can penetrate between the outer pane 17, the intermediate panes and the inner pane. Moreover, the shielding facility 22A can also conceal technical components so that these components are not seen by a user.

The handle 6 can be attached at different heights and in different portions of the door 3A. The shielding facility 22A prevents thermal radiation from coming into contact with the door supports 18, 19, which are preferably produced from plastic, and with the outer pane 17 in an upper region of the door 3A. To this end, the shielding facility 22A can have a reflective surface. The handle 6 is prevented from having too great a temperature by the handle 6 being shielded from thermal radiation. The air cushion provided in the gap 35 brings about a thermal insulation. The shielding facility 22A is captively connected to the door supports 18, 19. This results in a pull-off force of more than 50 N. Even if the adhesive bond between the door supports 18, 19 and the outer pane 17 fails, it is ensured that no components can be released from the door 3A.

The shielding facility 22A is preferably produced from stainless steel and has a brushed surface for an improved reflective behavior. Alternatively, the shielding facility 22A can also be produced from a plastics material. In this case, a reflective surface can then be attached to the shielding facility 22A. The air cushion in the gap 35 is designed as far as possible to be closed. The locking of the shielding facility 22A to the door supports 18, 19 ensures the safety of the user, even in the case of a failure of the adhesive bond between the door supports 18, 19 and the outer pane 17. The airflow and reflective behavior improve the temperature properties, both in terms of energy consumption and in the surface temperature.

A contact pressure is achieved toward the inner face 20 of the outer pane 17 by a bulged portion being provided in the upper region of the shielding facility 22A, said bulged portion ensuring a rattle-free retention and preventing a visible gap between the shielding facility 22A and the inner face 20. Alternatively, the gap 35 can also be ventilated. To this end, recesses through which air can flow can be provided on the support portions 28, 30. Moreover, the second support portion 30 can also have a perforation. The advantages of the door 3A are a greater energy efficiency, lower front temperatures and thus compliance with strict standards, an improved cleaning result in pyrolysis mode, safety in the case of a failure of the adhesive bond between the door supports 18, 19 and the outer pane 17, as well as simple assembly.

Figure 6:
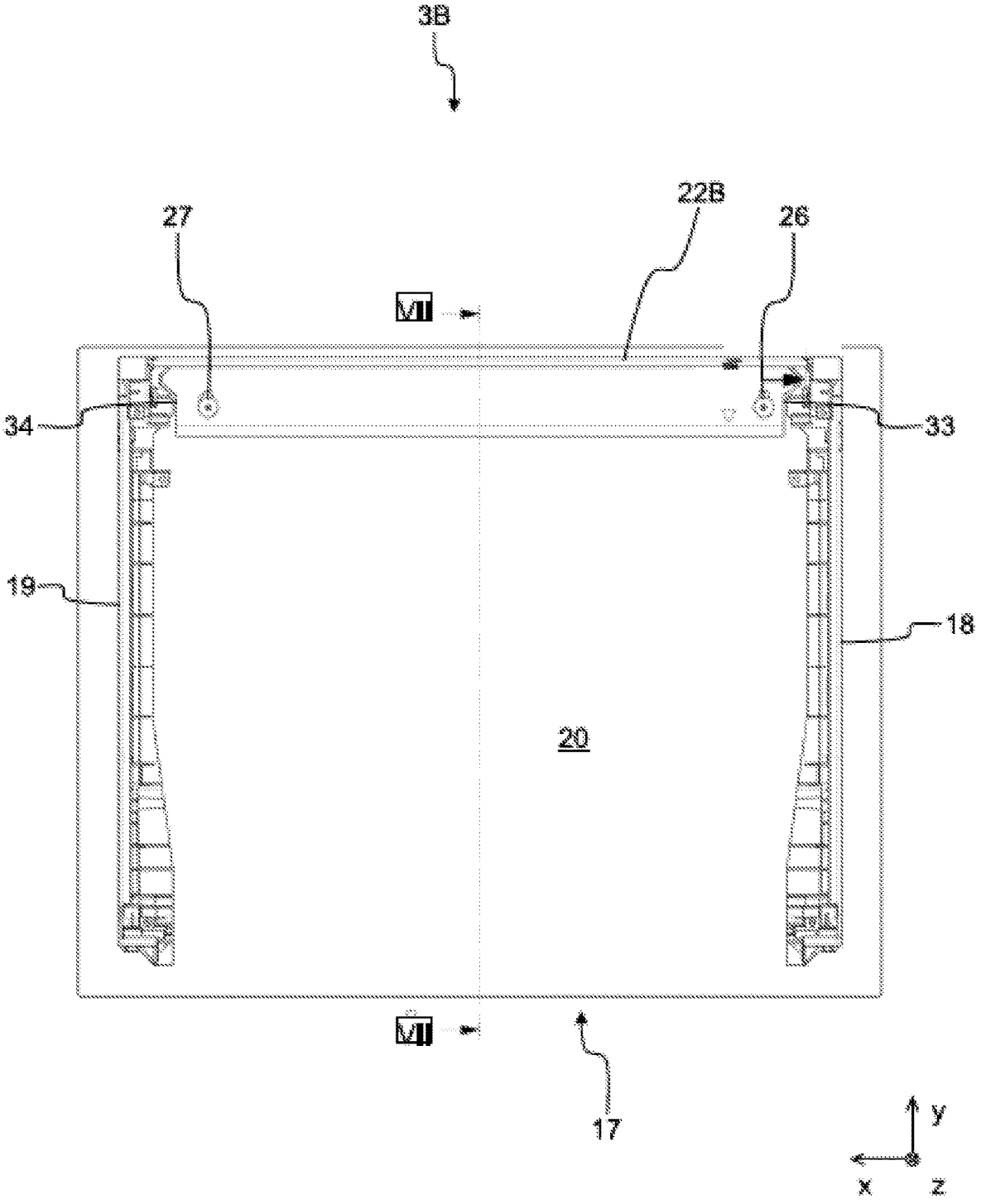
FIG. 6 shows a schematic plan view of a further embodiment of a door for the household cooking appliance according to FIG. 1.
Figure 7:
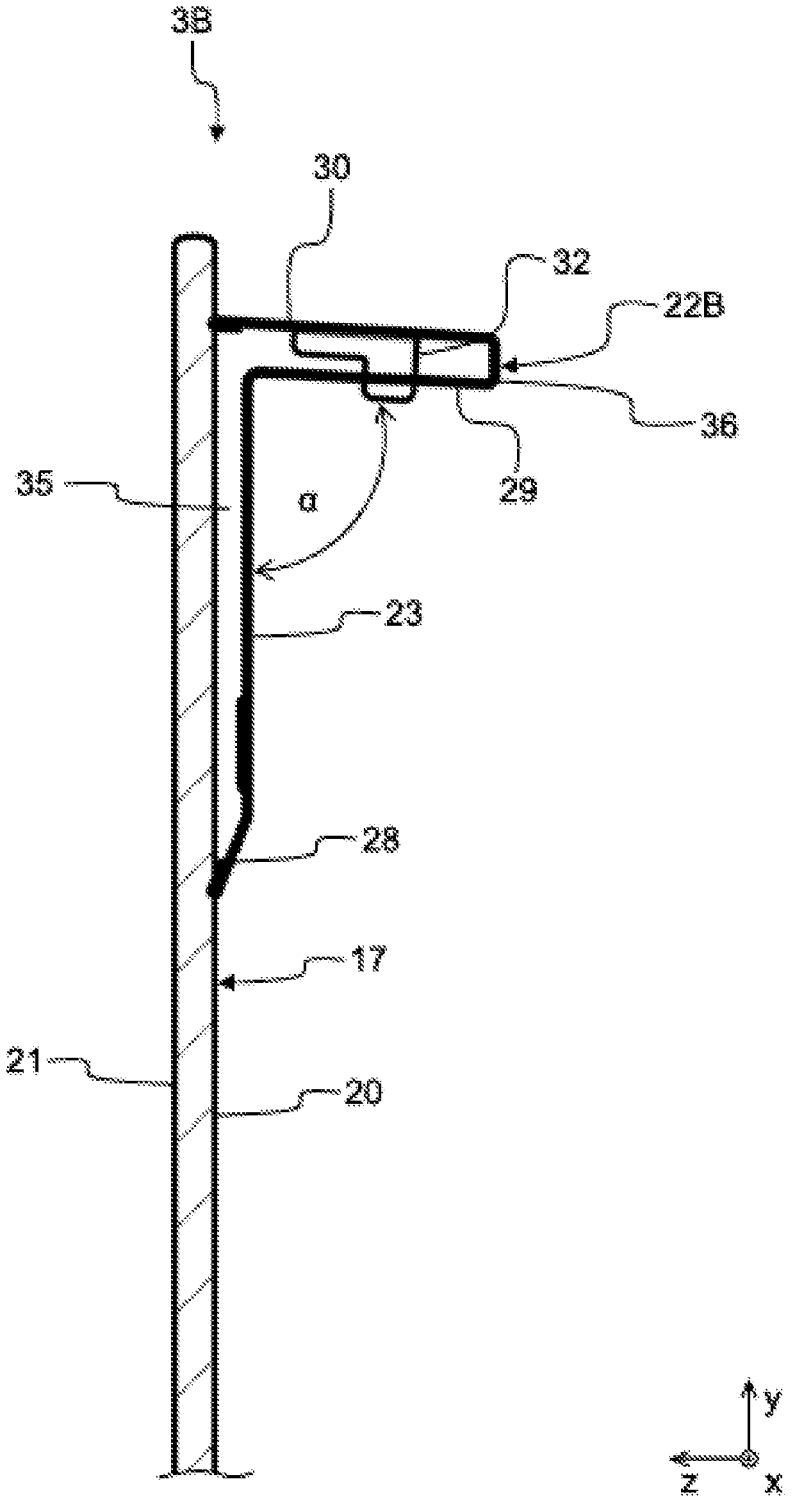
FIG. 7 shows a schematic sectional view of the door along the cutting line VII-VII of FIG. 6.
Figure 8:
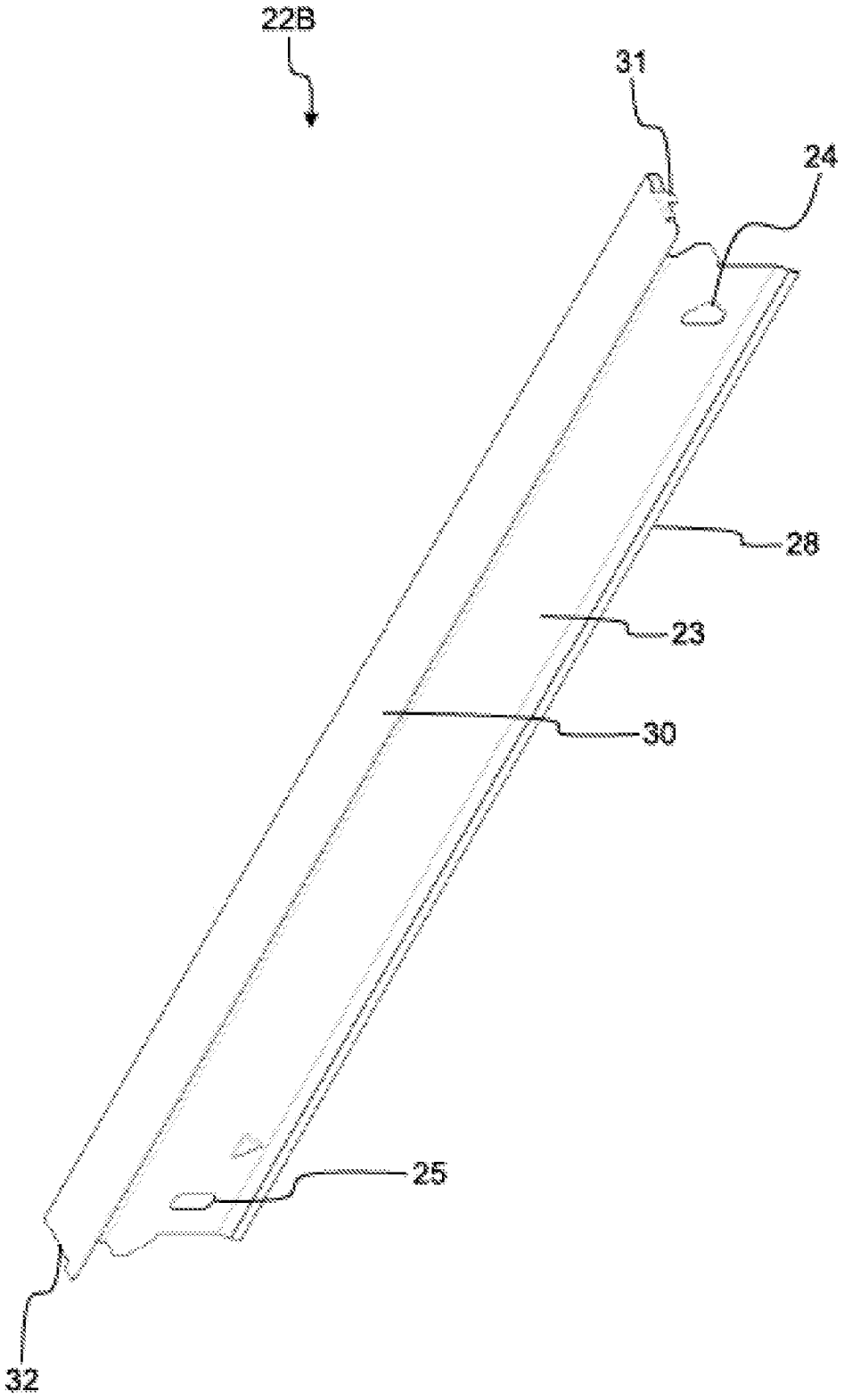
FIG. 8 shows a schematic perspective view of an embodiment of a shielding facility for the door according to FIG. 6.
Figure 9:
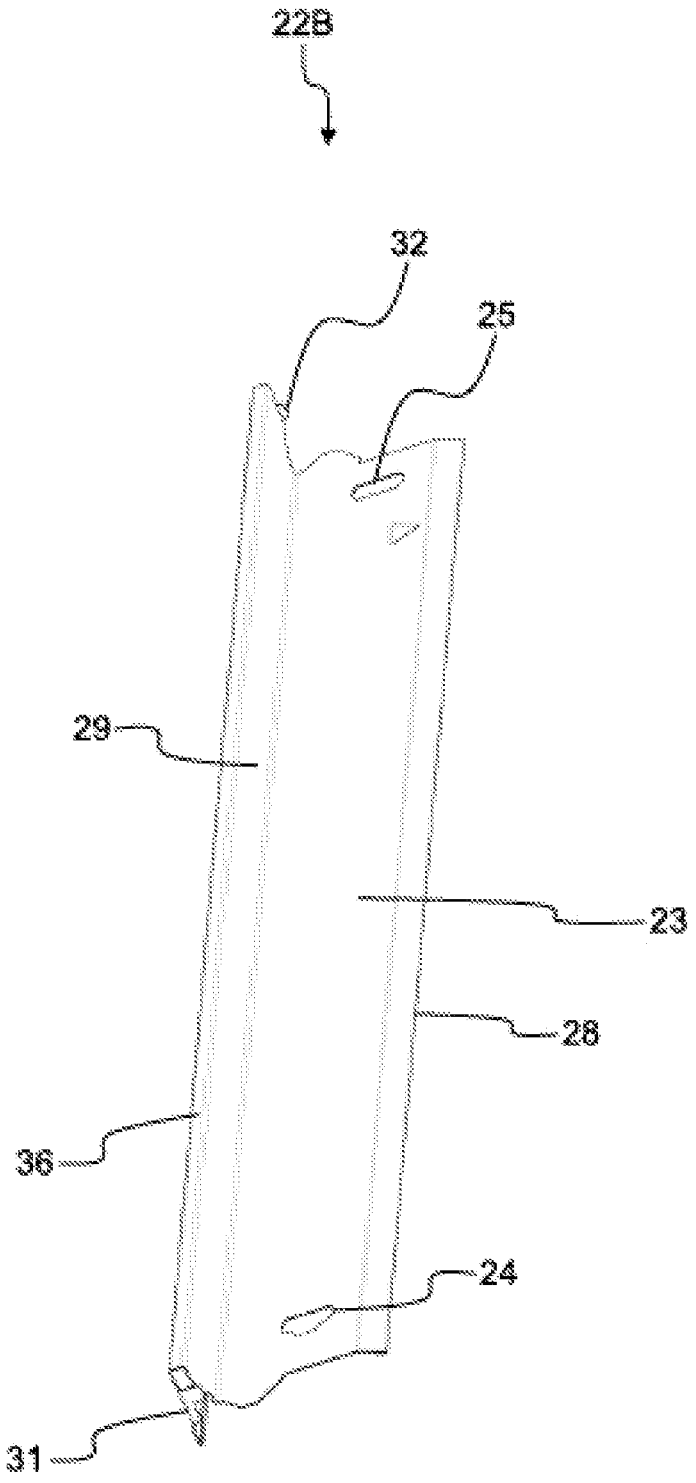
FIG. 9 shows a further schematic perspective view of the shielding facility according to FIG. 8.

FIG. 6 shows a schematic view of a further embodiment of a door 3B with a further embodiment of a shielding facility 22B. FIG. 7 shows a schematic sectional view of the door 3B along the cutting line VII-VII of FIG. 6. FIG. 8 shows a schematic perspective view of the shielding facility 22B. FIG. 9 shows a further schematic perspective view of the shielding facility 22B. Reference is made to FIGS. 6 to 9 hereinafter at the same time.

The shielding facility 22B differs substantially from the shielding facility 22A in that the angle of inclination a between the base portion 23 and the portion 29 is preferably 90°. In this case, a further portion 36 is provided between the portion 29 and the second support portion 30.

Figure 10:
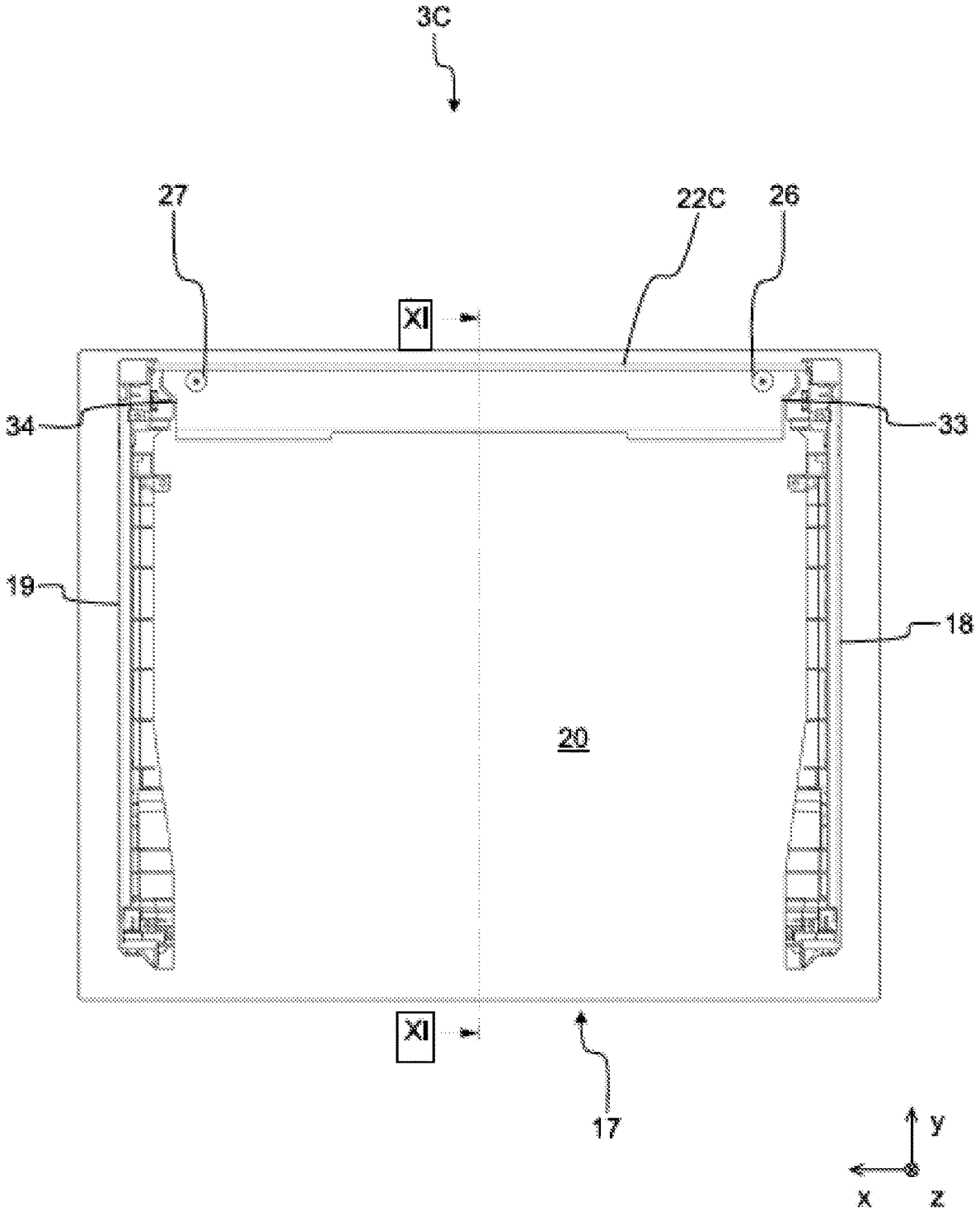
FIG. 10 shows a schematic plan view of a further embodiment of a door for the household cooking appliance according to FIG. 1.
Figure 11:
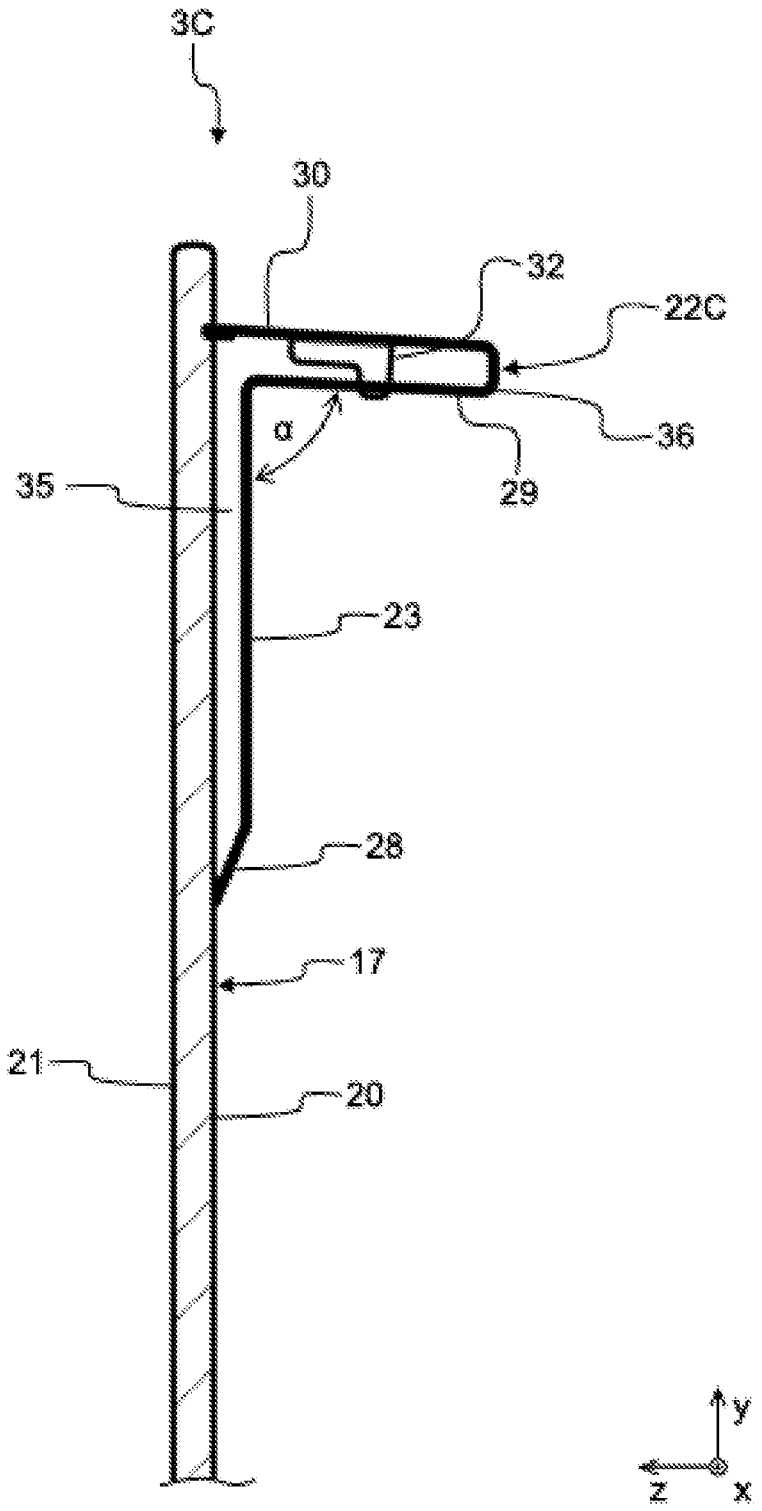
FIG. 11 shows a schematic sectional view of the door according to FIG. 10.
Figure 12:
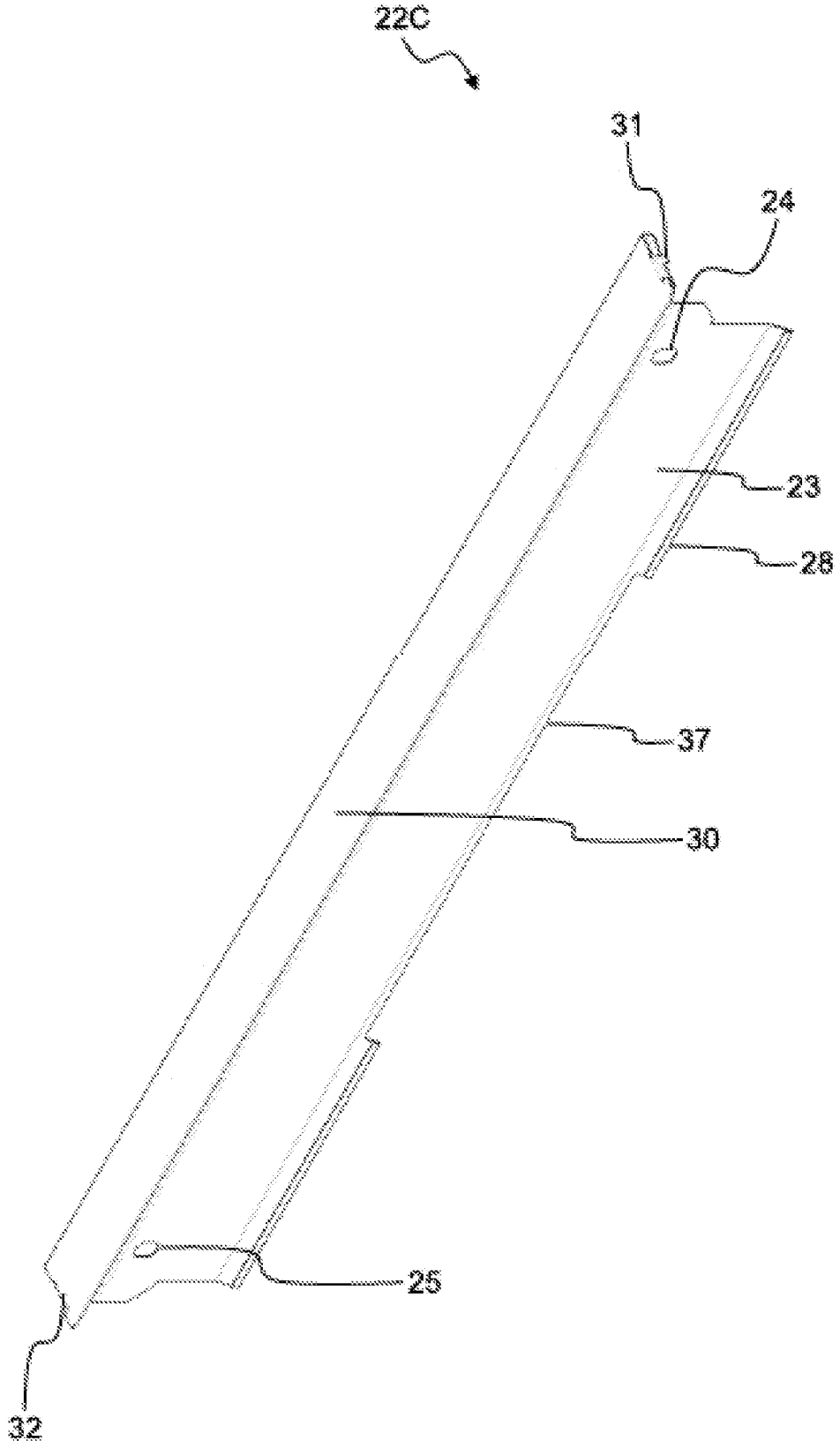
FIG. 12 shows a schematic perspective view of an embodiment of a shielding facility for the door according to FIG. 10.
Figure 13:
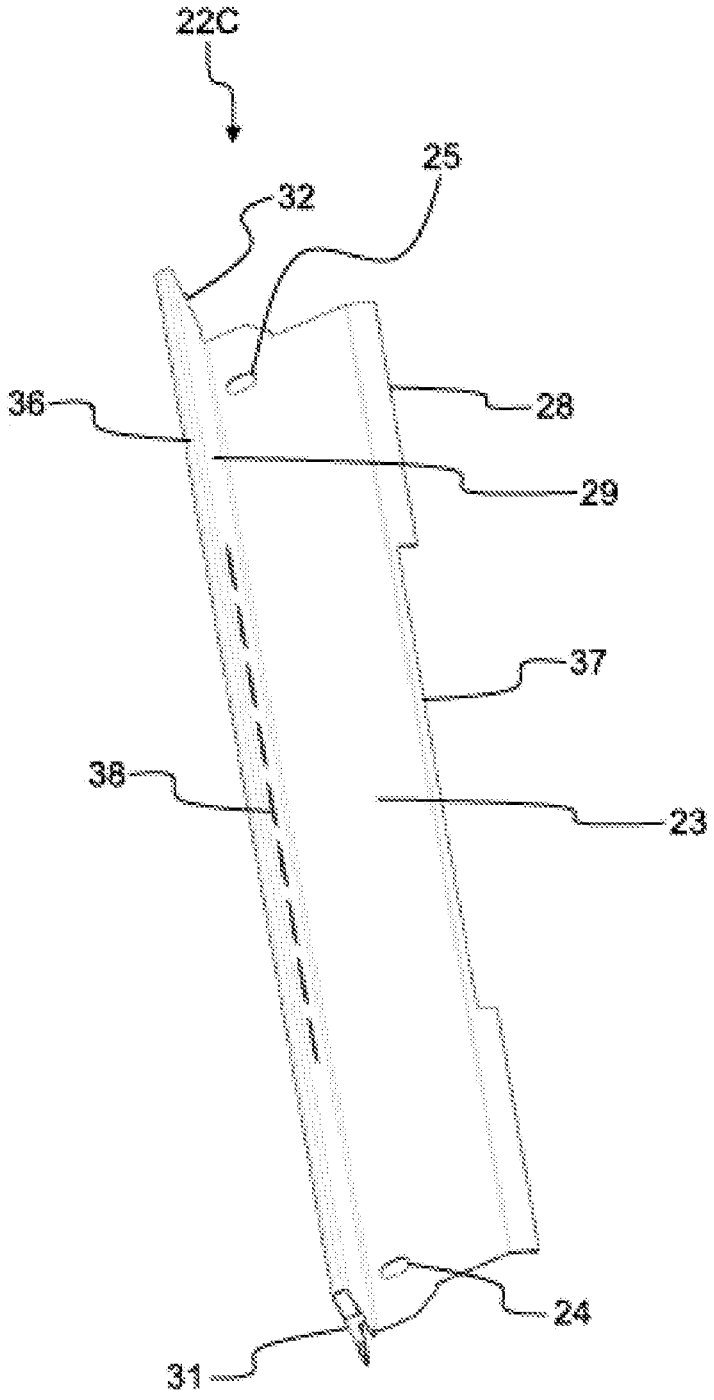
FIG. 13 shows a further schematic perspective view of the shielding facility according to FIG. 12.

FIG. 10 shows a schematic plan view of a further embodiment of a door 3C with a further embodiment of a shielding facility 22C. FIG. 11 shows a schematic sectional view of the door 3C along the cutting line XI-XI of FIG. 10. FIG. 12 shows a schematic perspective view of the shielding facility 22C. FIG. 13 shows a further schematic perspective view of the shielding facility 22C. Reference is made to FIGS. 10 to 13 hereinafter at the same time.

The shielding facility 22C differs substantially from the shielding facility 22B in that the first support portion 28 has a cut-out 37, air being able to flow through said cut-out in the gap 35 between the shielding facility 22C and the outer pane 17. Moreover, the shielding facility 22C has ventilation slots 38 in the region of the portion 29. The air can flow into the gap 35 through the cut-out 37. The air can flow out again through the ventilation slots 38.

Figure 14:
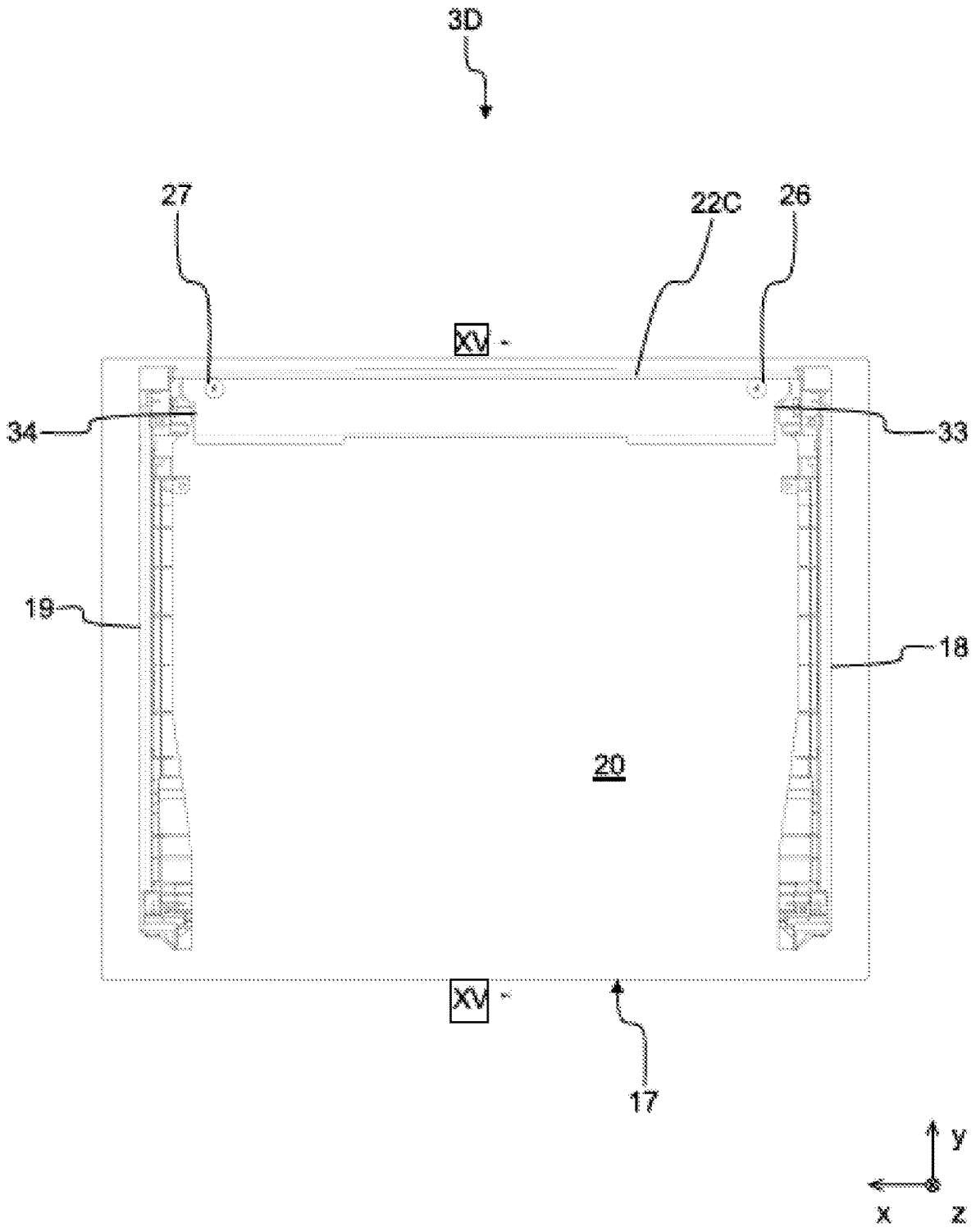
FIG. 14 shows a schematic plan view of a further embodiment of a door for the household cooking appliance according to FIG. 1.
Figure 15:
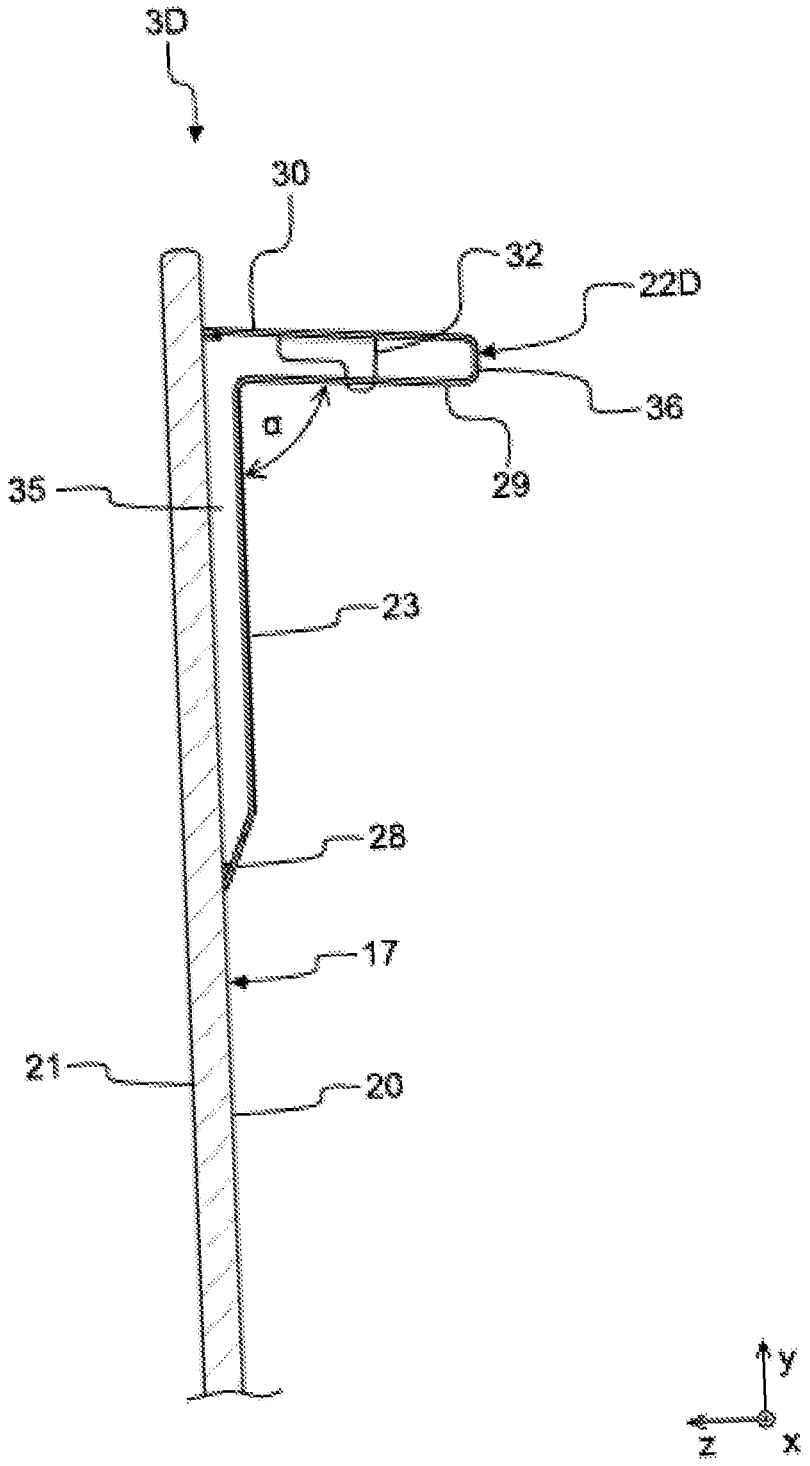
FIG. 15 shows a schematic sectional view of the door along the cutting line XV-XV of FIG. 14.
Figure 16:
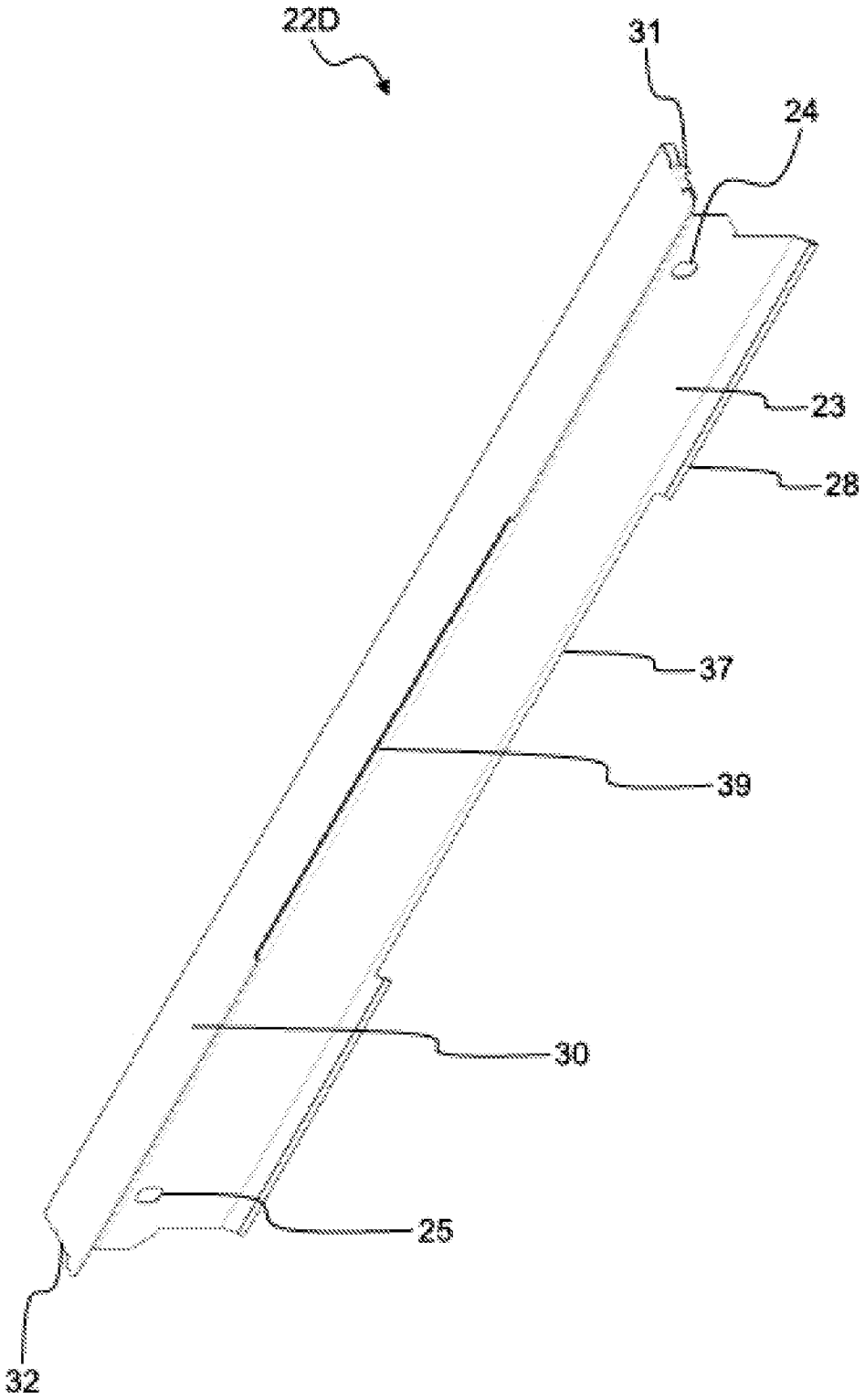
FIG. 16 shows a schematic perspective view of an embodiment of a shielding facility for the door according to FIG. 14.
Figure 17:
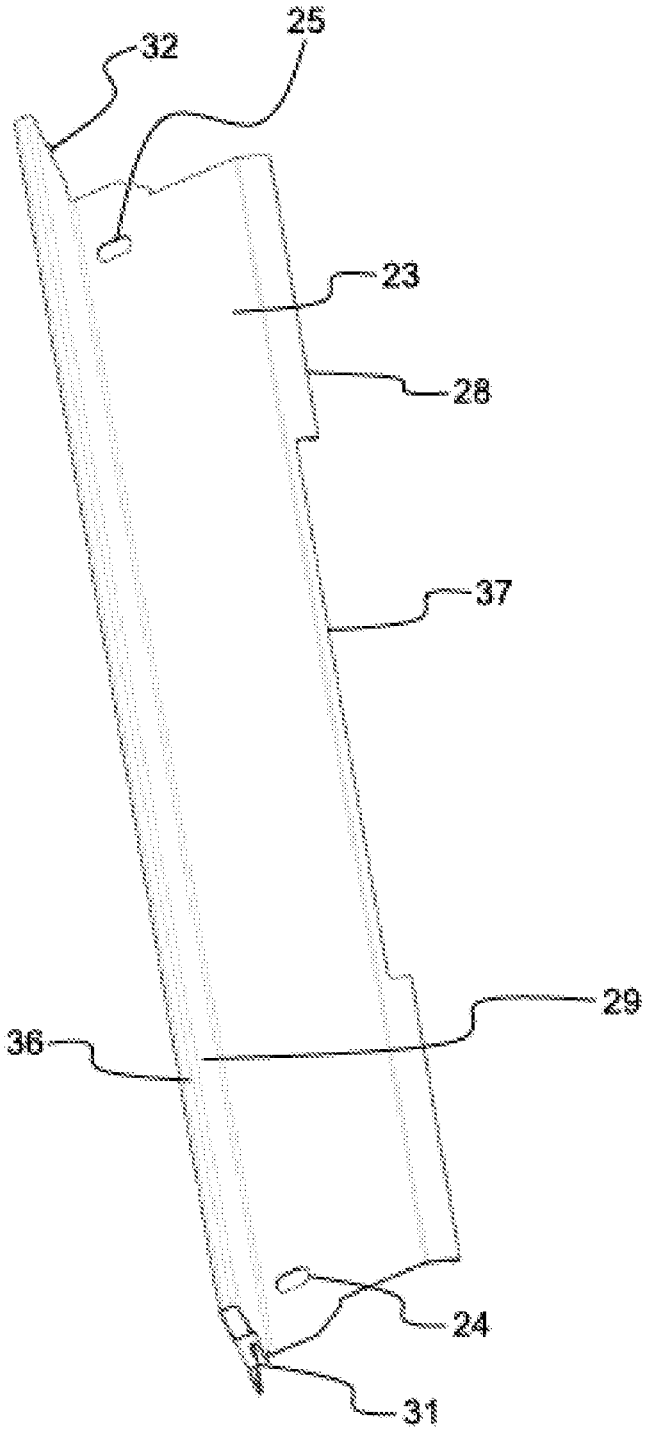
FIG. 17 shows a further schematic perspective view of the shielding facility according to FIG. 16.

FIG. 14 shows a schematic view of a further embodiment of a door 3D with a further embodiment of a shielding facility 22D. FIG. 15 shows a schematic sectional view of the door 3D along the cutting line XV-XV of FIG. 14. FIG. 16 shows a schematic perspective view of the shielding facility 22D. FIG. 17 shows a further schematic perspective view of the shielding facility 22D. Reference is made to FIGS. 14 to 17 hereinafter at the same time.

The shielding facility 22D differs substantially from the shielding facility 22C in that no ventilation slots 38 are provided on the portion 29, but a cut-out 39 which corresponds to the cut-out 37 of the first support portion 28 and through which the gap 35 can be ventilated is provided on the second support portion 30.

Although the present invention has been described with reference to exemplary embodiments, it can be modified in many different ways.

The invention claimed is:

1. A door for a household cooking appliance, said door comprising:

an outer pane;

a first door support connected to the outer pane;

a second door support connected to the outer pane; and a shield having at least one portion configured to shield the outer pane and at least one of the first and second door supports from thermal radiation, said shield arranged between the first door support and the second door support, and at least one of the first and second door supports having at least one portion arranged between the outer pane and the shield, wherein the shield has an extending portion that extends a first distance from the outer pane in a first direction away from the outer pane, the shield has a plate-shaped base portion, the base portion having a parallel portion that is parallel to a surface of the outer plane and is spaced in the first direction a second distance from the surface of the outer pane, and an angled portion that extends from the parallel portion and contacts the outer pane, the second distance is less than the first distance, the door has a pivot edge that is a closest edge of the door to a pivot point about which the door is configured to pivot between an open position and a closed position, the extending portion is located between the base portion and a first edge of the outer pane, the first edge of the outer pane is an edge of the outer pane that is farthest from the pivot edge, the parallel portion of the base portion and the outer pane define a gap therebetween, and the gap extends along an entirety of the parallel portion.

2. The door of claim 1, wherein the shield comprises a first tab in engagement with the first door support and a second tab in engagement with the second door support.

3. The door of claim 1, wherein the shield is supported on the outer pane.

4. The door of claim 1, wherein the shield comprises ventilation slots.

5. The door of claim 1, wherein the shield has a side which faces away from the outer pane and has a property which reflects thermal radiation.

6. The door of claim 1, wherein the shield is a bent sheet metal component.

7. The door of claim 1, further comprising:

a handle provided on the door; and a fastener for fastening the handle to the door, said fastener being guided through a through-hole on the shield.

8. The door of claim 7, wherein the fastener positively engages behind the shield.

9. The door of claim 7, wherein the shield is configured to shield the handle from thermal radiation.

10. The door of claim 1, wherein the shield comprises a first support portion which is supported on the outer pane and a second support portion which is also supported on the outer pane.

11. The door of claim 10, wherein the first support portion has a cut-out for passage of air between the shield and the outer pane.

12. The door of claim 10, wherein the second support portion of the shield comprises a cut-out.

13. The door of claim 10, wherein the first door support and the second door support are arranged spaced apart from one another, when viewed in a width direction of the door, said shield running between the first door support and the second door support, when viewed in the width direction.

14. The door of claim 10, further comprising a fastener guided through a through-hole on the shield for fastening a handle to the door, said first and second door supports being coupled to the outer pane by the shield and the fastener.

15. A household cooking appliance, comprising:

a cooking chamber; and a door attached to the cooking chamber, said door comprising an outer pane, a first door support connected to the outer pane, a second door support connected to the outer pane, and a shield having at least one portion configured to shield the outer pane and at least one of the first and second door supports from thermal radiation, said shield arranged between the first door support and the second door support, and at least one of the first and second door supports having at least one portion arranged between the outer pane and the shield, wherein the shield has an extending portion that extends a first distance from the outer pane in a first direction away from the outer pane, the shield has a plate-shaped base portion, the base portion having a parallel portion that is parallel to a surface of the outer plane and is spaced in the first direction a second distance from the surface of the outer pane, and an angled portion that extends from the parallel portion and contacts the outer pane, the second distance is less than the first distance, the door has a pivot edge that is a closest edge of the door to a pivot point about which the door pivots between an open position and a closed position, the extending portion is located between the base portion and a first edge of the outer pane, the first edge of the outer pane is an edge of the outer pane that is farthest from the pivot edge, the parallel portion of the base portion and the outer pane define a gap therebetween, and the gap extends along an entirety of the parallel portion.

16. The household cooking appliance of claim 15, wherein the at least one portion of the shield has a cut-out for passage of air between the shield and the outer pane.

17. The household cooking appliance of claim 16, wherein the base portion of the shield comprises the cut-out.

18. The household cooking appliance of claim 15, wherein the first door support and the second door support are arranged spaced apart from one another, when viewed in a width direction of the door, said shield running between the first door support and the second door support, when viewed in the width direction.

19. The household cooking appliance of claim 15, wherein the door comprises a fastener guided through a through-hole on the shield for fastening a handle to the door, said first and second door supports being coupled to the outer pane by the shield and the fastener.

* * * * *